US005432529A

United States Patent [19]

Azuhata

[11] Patent Number: 5,432,529

[45] Date of Patent: Jul. 11, 1995

[54] OUTPUT CIRCUIT FOR ELECTRONIC DISPLAY DEVICE DRIVER

[75] Inventor: Hiroaki Azuhata, Tokyo, Japan

[73] Assignee: NEC Corporation, Tokyo, Japan

[21] Appl. No.: 57,844

[22] Filed: May 7, 1993

[30] Foreign Application Priority Data

May 7, 1992 [JP] Japan ..... 4-114391

[51] Int. Cl.[6] ..... G09G 3/36

[52] U.S. Cl. ..... 345/100; 345/99

[58] Field of Search ..... 345/98, 99, 100, 60, 345/68

[56] References Cited

U.S. PATENT DOCUMENTS 4,748,444 5/1988 Arai ..... 345/99

5,194,853 3/1993 Asada ..... 345/100

*Primary Examiner*—Richard Hjerpe

*Assistant Examiner*—Vivian W. Chang

*Attorney, Agent, or Firm*—Sughrue, Mion, Zinn, Macpeak & Seas

[57] ABSTRACT

An output circuit used in a common driver for a flat panel electronic display device includes "n" two-input OR circuits of a CMOS circuit structure, where "n" is a positive integer corresponding to the number of a row electrodes of a flat panel display. One input of each of the OR circuits is connected to a corresponding bit of an n-bit shifter register, and an output of the OR circuits is connected to a corresponding one of the row electrodes of the flat panel display so as to drive the corresponding electrode. A control signal is connected directly to the other input of the first OR circuit and a first one of "n-1" cascaded non-inverting buffers. Outputs of these cascaded non-inverting buffers are connected to the other input of the remaining OR circuits, respectively.

11 Claims, 5 Drawing Sheets

FIGURE 4A
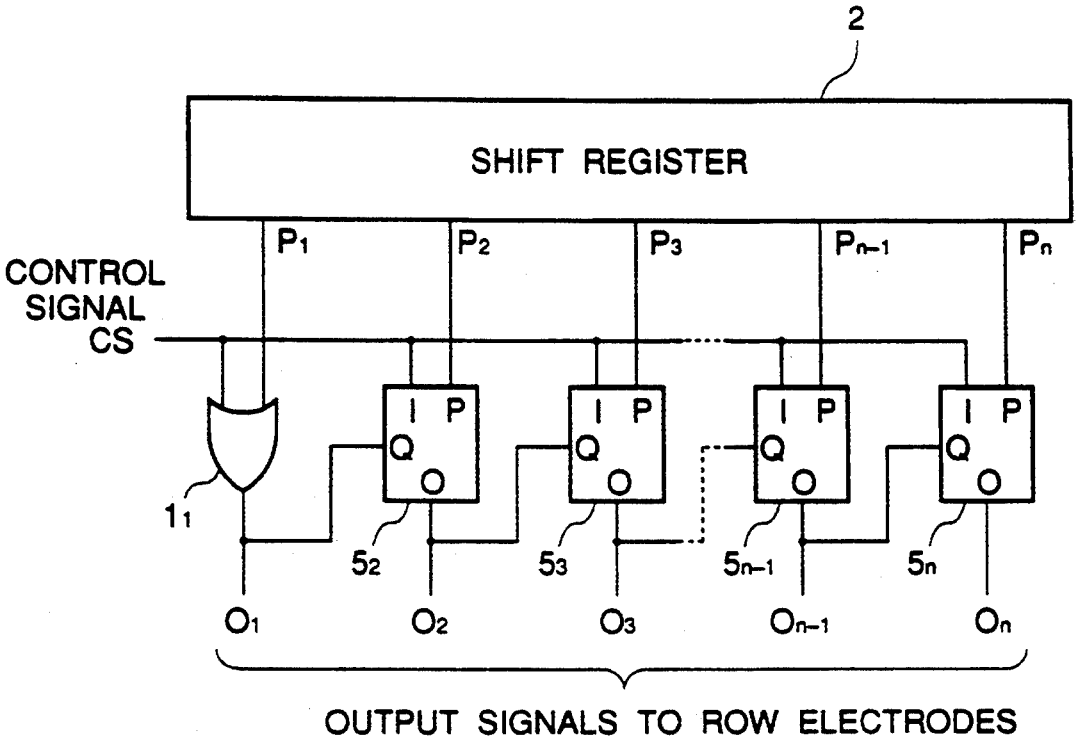
FIGURE 4B
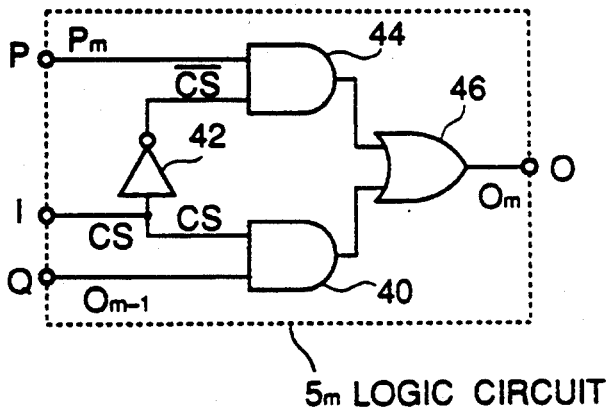
FIGURE 4C
| CS | Pm | Om-1 | Om |
|---|---|---|---|
| L | L | L | L |
| L | L | H | L |
| L | H | L | H |
| L | H | H | H |
| H | L | L | L |
| H | L | H | H |
| H | H | L | L |
| H | H | H | H |

FIGURE 4D
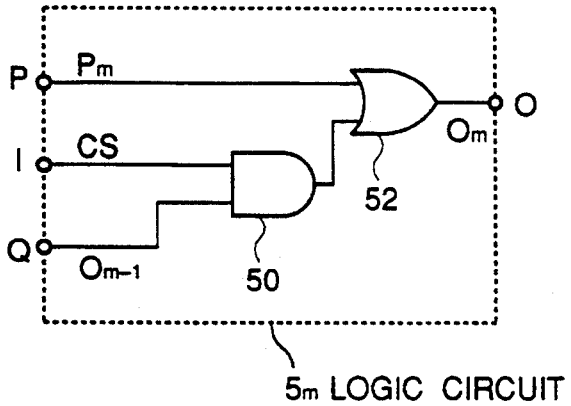
FIGURE 4E
| CS | $P_m$ | $O_{m-1}$ | $O_m$ |
|---|---|---|---|
| L | L | L | L |
| L | L | H | L |
| L | H | L | H |
| L | H | H | H |
| H | L | L | L |
| H | L | H | H |
| H | H | L | H |
| H | H | H | H |
FIGURE 5
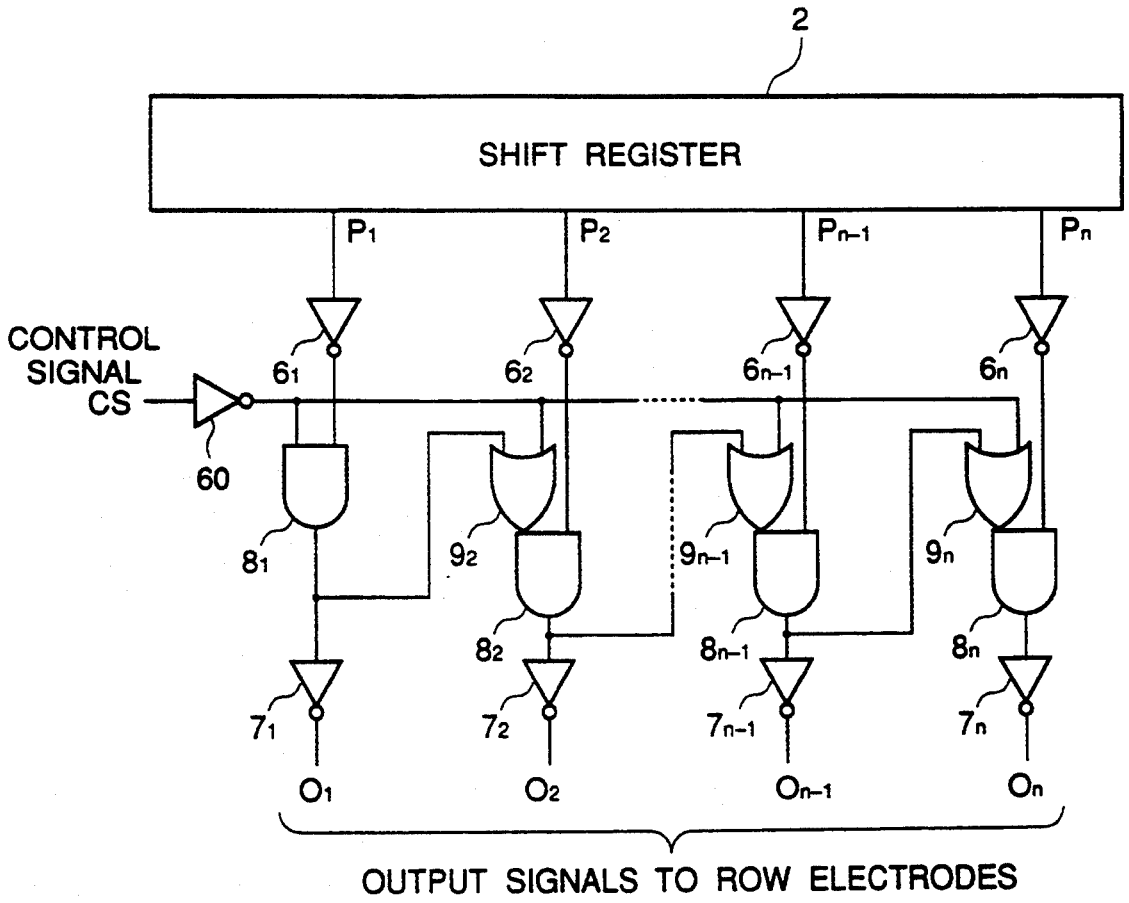

OUTPUT CIRCUIT FOR ELECTRONIC DISPLAY DEVICE DRIVER

BACKGROUND OF THE INVENTION

1. Field of the Invention

The present invention relates to an output circuit for an electronic display device driver, and more specifically to an output circuit of a CMOS structure used in a common driver for a flat panel electronic display device such as a liquid crystal display, an electroluminescent display, a plasma display panel, and the like.

2. Description of Related Art

Conventionally, a flat panel electronic display device driver of a matrix electrode structure includes a number of row (or scanning) electrodes formed on a first substrate and a number of column (or signal) electrodes formed on a second substrate orthogonally to the row electrodes. A voltage is applied to selected ones of intersections (pixels) between the row electrodes and the column electrodes, so that a character display, a graphic display or a movie display is effected.

The row electrodes are associated with a common driver, so that in an ordinary operation, the row electrodes are sequentially scanned by the common driver in a line sequential scanning manner. When the display panel is to be reset, all of the row electrodes are forcibly brought into a "H" (high logical) level or into a "L" (low logical) level. The output circuit used in the common driver for the flat panel electronic display device has the above mentioned function. In the following, the output circuit used in the common driver for the flat panel electronic display device will be sometimes called simply an "output circuit".

A typical output circuit used in the common driver for the flat panel electronic display device includes "n" 2-input OR circuits where "n" is a positive integer and corresponds to the number of the row electrodes of the display panel. One input of each of the OR circuits is connected to receive a control signal from an external of the output circuit. The other input of the OR circuits is connected to receive a corresponding bit of an n-bit shift register, and an output of the OR circuits is connected to a corresponding one of the row electrodes of the display panel so as to drive the corresponding electrode.

In this conventional output circuit, when the display panel performs an ordinary display operation, the control signal is maintained at the "L" level, an output signal of each stage of the shift register is outputted, as it is, from the associated OR circuit, so that the row electrodes of the display panel are sequentially scanned. On the other hand, at the time of resetting the display panel, the control signal is brought to the "H" level, so that the output signal of all the OR circuits are brought to the "H" level at once, regardless of the output signal of the respective stages of the shift register.

As mentioned above, when all the output signals of the output circuit are brought into the "H" level (or in the "L" level in the case of a negative logic) in accordance with the control signal, all the output signals are simultaneously brought into the "H" level. Therefore, in case that the output circuit is formed of a CMOS (complementary metal-oxide-semiconductor transistor) circuit, when the output signals are switched over, a pass-through current of the amount in proportion to the number of the output signals flows. In other words, a large voltage supply current flows transiently.

In the case that the common driver including the above mentioned output circuit is formed in an integrated circuit, if the above mentioned large current flows in the voltage supply, a latch-up phenomenon often occurs, or a noise is superimposed on signal conductors, or the voltage supply-voltage becomes unstable. As a result, the integrated circuit becomes easy to malfunction.

SUMMARY OF THE INVENTION

Accordingly, it is an object of the present invention to provide an output circuit which is used in a common driver for a flat panel electronic display device, and which has overcome the above mentioned defect of the conventional one.

Another object of the present invention is to provide an output circuit which is used in a common driver for a flat panel electronic display device, and which has a reduced transient increase of a voltage supply current which occurs when all outputs of the common driver are forcibly brought to a "H" or "L" level in order to reset the display panel.

The above and other objects of the present invention are achieved in accordance with the present invention by an output circuit for a flat panel electronic display device driving circuit, the output circuit being configured to receive a plurality of input signals and controlled by one binary control signal so as to supply the received input signals as output signals when the control signal is at a first logical level, and to forcibly bring the output signals to the same logical level which is one level of a pair of complementary logical levels when the control signal is at a second logical level complementary to the first logical level, the output circuit including means for sequentially bring the output signals to the above mentioned same logical level when the control signal is at the second logical level.

The above and other objects, features and advantages of tho present invention will be apparent from the following description of preferred embodiments of the invention with reference to the accompanying drawings.

BRIEF DESCRIPTION OF THE DRAWINGS

FIG. 4A is a block diagram of a third embodiment of the output circuit in accordance with the present invention;

FIG. 4B is a logic circuit diagram of one example of the logic circuit used in the third embodiment shown in FIG. 4A;

FIG. 4C is a truth table of the logic circuit shown in FIG. 4B;

FIG. 4D is a logic circuit diagram of another example of the logic circuit used in the third embodiment shown in FIG. 4A;

FIG. 4E is a truth table of the logic circuit shown in FIG. 4D; and

FIG. 5 is a block diagram of a fourth embodiment of the output circuit in accordance with the present invention.

DESCRIPTION OF THE PREFERRED EMBODIMENTS

Figure 1:
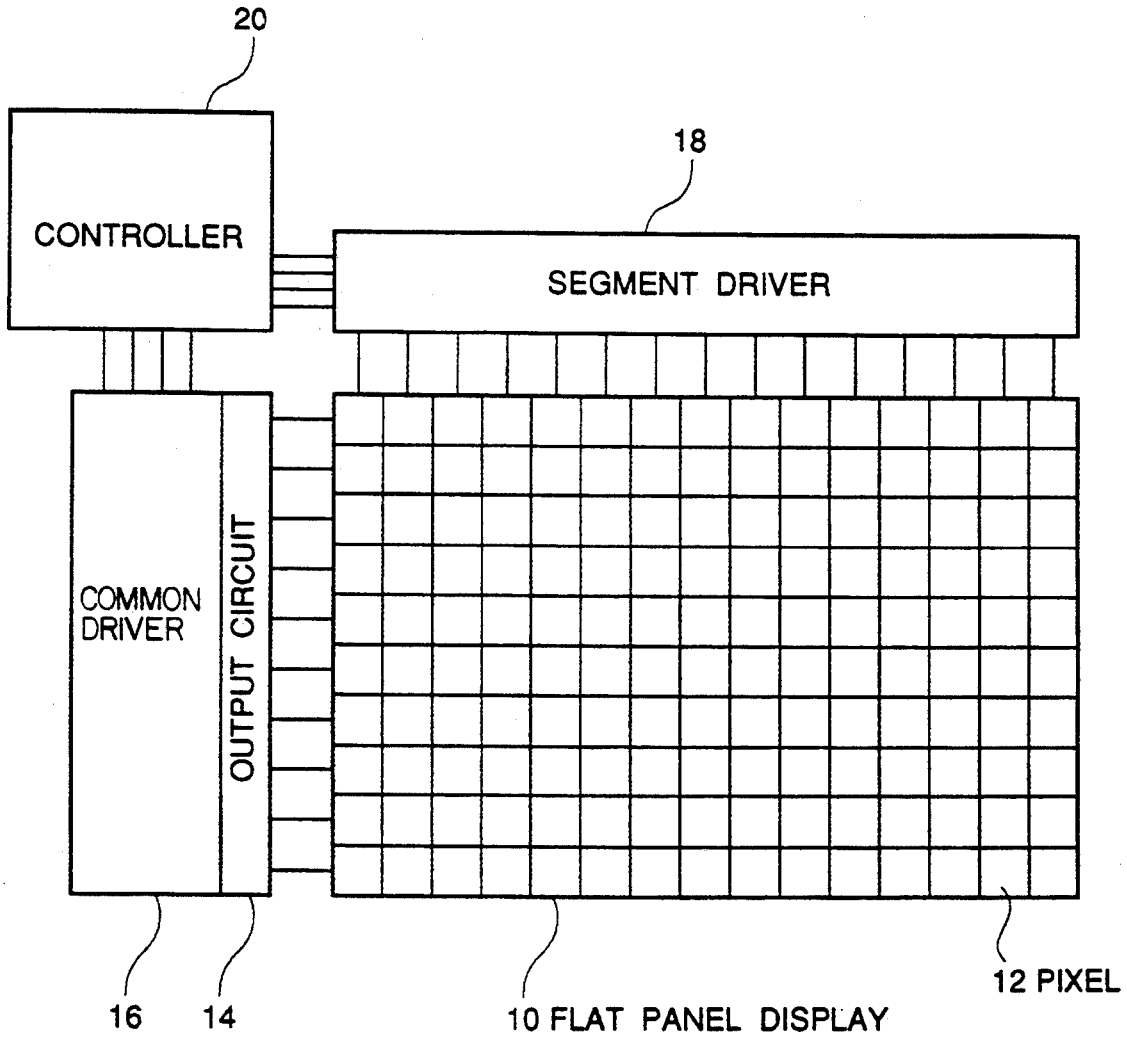
FIG. 1 is a block diagram of a flat panel electronic display device, which can incorporate therein the output circuit in accordance with the present invention.

Referring to FIG. 1, there is shown a block diagram of a flat panel electronic display device, which can incorporate therein the output circuit in accordance with the present invention. The flat panel electronic display device includes a flat panel display 10, which includes a number of row electrodes (not shown) and a number of column electrodes (not shown) located orthogonally to each other so that a pixel 12 is formed at each of intersections between the row electrodes and the column electrodes. Each of the row electrodes is connected to a corresponding one of outputs of an output circuit 14 associated to a common driver 16, so that the row electrodes are selectively driven through the output circuit 14 by the common driver 16. On the other hand, each of the column electrodes is connected to a corresponding one of outputs of a segment driver 18. The common driver 16 and the segment driver 18 are controlled by a controller 20.

The above mentioned construction and an operation of the flat panel electronic display device is well known to persons skilled in the art, and therefore, further explanation will be omitted.

Figure 2A:
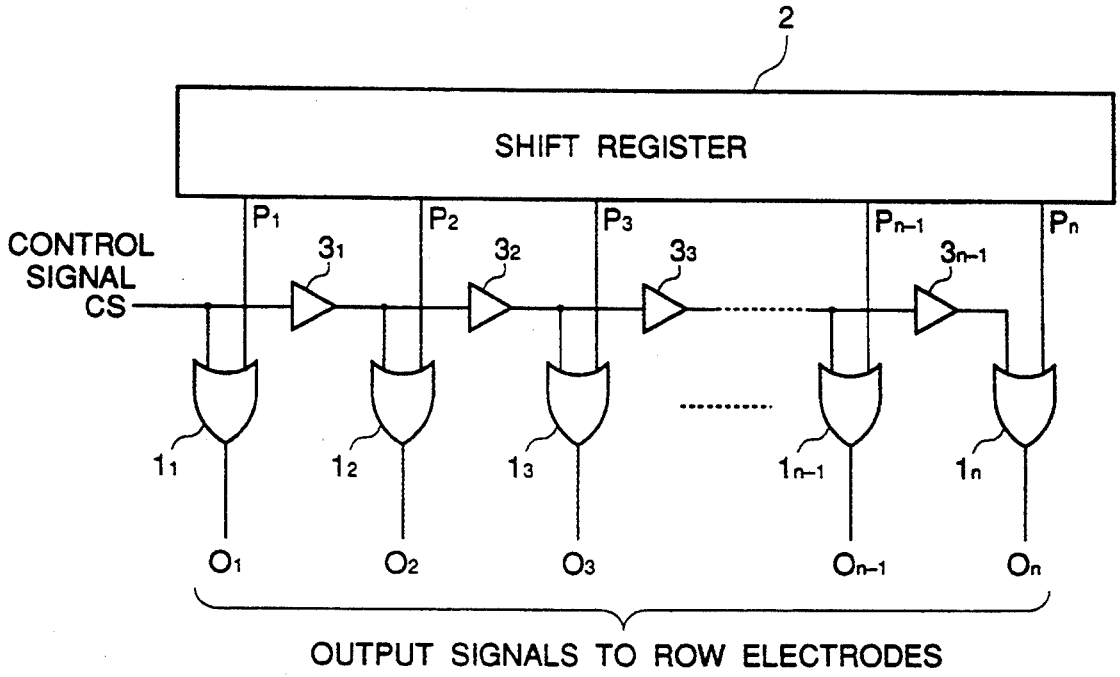
FIG. 2A is a block diagram of a first embodiment of the output circuit in accordance with the present invention.

Referring to FIG. 2A, there is shown a block diagram of a first embodiment of the output circuit in accordance with the present invention, which can be used as the output circuit 14 shown in FIG. 1.

The output circuit shown in FIG. 1 includes "n" two-input OR circuits $\mathbf{1}_1$ to $\mathbf{1}_n$ of a CMOS circuit structure, where "n" is a positive integer greater than "1" and corresponds to the number of the row electrodes of the flat panel display 10. One input of each of the OR circuits $\mathbf{1}_1$ to $\mathbf{1}_n$ is connected to a corresponding bit $P_1$ to $P_n$ of an n-bit shifter register 2, and an output $O_1$ to $O_n$ of the OR circuits $\mathbf{1}_1$ to $\mathbf{1}_n$ is connected to a corresponding one of the row electrodes of the flat panel display 10 so as to drive the corresponding electrode.

A control signal CS is connected directly to the other input of the first OR circuit $\mathbf{1}_1$ and a first one of "n-1" cascaded non-inverting buffers $\mathbf{3}_1$ to $\mathbf{3}_{n-1}$. An output of these cascaded non-inverting buffers $\mathbf{3}_1$ to $\mathbf{3}_{n-1}$ are connected to the other input of the OR circuits $\mathbf{1}_2$ to $\mathbf{1}_n$, respectively.

With the above mentioned arrangement, the control signal CS is applied to the first OR circuit $\mathbf{1}_1$ without delay, but the control signal CS is applied to the second OR circuit $\mathbf{1}_2$ with a delay corresponding to a signal propagation delay time of the buffer $\mathbf{3}_1$. Similarly, the control signal CS is sequentially applied to the third and succeeding OR circuit $\mathbf{1}_3$ to $\mathbf{1}_n$ with a time delay given by the buffers $\mathbf{3}_1$ to $\mathbf{3}_{n-1}$. Therefore, when the control signal CS is brought to the "H" level, all the output signals $O_1$ to $O_n$ of the OR circuits $\mathbf{1}_1$ to $\mathbf{1}_n$ are never brought to the "H" level at the same timing or instant. In other words, the output signals $O_1$ to $O_n$ of the OR circuits $\mathbf{1}_1$ to $\mathbf{1}_n$ are sequentially brought to the "H" level with a respective time difference or delay which is given by the buffers $\mathbf{3}_1$ to $\mathbf{3}_{n-1}$, respectively. As a result, since the pass-through current of the respective OR circuits does not flow simultaneously, a voltage supply current is not greatly increased by the pass-through current of the respective OR circuits.

For example, if the cascaded non-inverting buffers $\mathbf{3}_1$ to $\mathbf{3}_{n-1}$ have the same signal propagation delay time and if the OR circuits $\mathbf{1}_1$ to $\mathbf{1}_n$ also have the same signal propagation delay time, the output signals $O_1$ to $O_n$ of the OR circuits $\mathbf{1}_1$ to $\mathbf{1}_n$ are sequentially brought to the "H" level with the same time intervals which correspond to the delay time of the buffers $\mathbf{3}_1$ to $\mathbf{3}_{n-1}$.

Figure 2B:
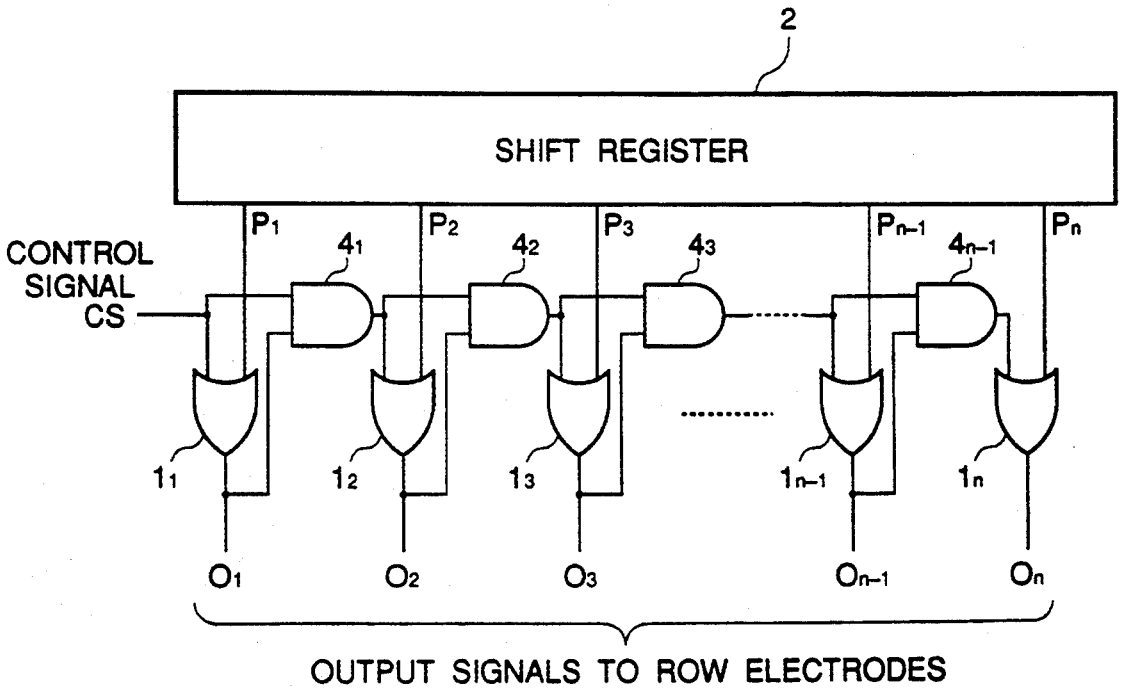
FIG. 2B is a block diagram of a second embodiment of the output circuit in accordance with the present invention.

Referring to FIG. 2B, there is shown a block diagram of a second embodiment of the output circuit in accordance with the present invention, which can be used as the output circuit 14 shown in FIG. 1. In FIG. 2B, elements similar to those shown in FIG. 2A are given the same Reference Numerals, and explanation thereof will be omitted.

As will be apparent from comparison between FIGS. 2A and 2B, "n-1" cascaded two-input AND circuits $\mathbf{4}_1$ to $\mathbf{4}_n$ are provided in place of the buffers $\mathbf{3}_1$ to $\mathbf{3}_{n-1}$, respectively. Namely, the control signal CS is supplied to the other input of the first OR circuit $\mathbf{1}_1$ and one input of the first AND gate $\mathbf{4}_1$. The other input of the first AND gate $\mathbf{4}_1$ is connected to the output of the first OR circuit $\mathbf{1}_1$, and an output of the first AND gate $\mathbf{4}_1$ is connected to the other input of the second OR circuit $\mathbf{1}_2$ and one input of the second AND gate $\mathbf{4}_2$. The other input of the second AND gate $\mathbf{4}_2$ is connected to the output of the second OR circuit $\mathbf{1}_2$, and an output of the second AND gate $\mathbf{4}_2$ is connected to the other input of the third OR circuit $\mathbf{1}_3$. Similarly, an output of the "m-1"th AND gate $\mathbf{4}_{m-1}$ (where "m" is a positive integer indicative of the order and is less than "n") is connected to the other input of the "m"th OR circuit $\mathbf{1}_m$ and one input of the "m"th AND gate $\mathbf{4}_m$. The other input of the "m"th AND gate $\mathbf{4}_m$ is connected to the output of the "m"th OR circuit $\mathbf{1}_m$. Finally, an output of the "n-1"th AND gate $\mathbf{4}_{n-1}$, which receives an output of the "n-1"th AND gate $\mathbf{4}_{n-2}$ and an output of the "n-1"th OR circuit $\mathbf{1}_{n-1}$, is connected to the other input of the "n"th OR circuit $\mathbf{1}_n$.

In this embodiment, when the control signal CS is brought to the "H" level, the output $O_1$ of the OR circuit $\mathbf{1}_1$ is immediately brought to the "H" level, but the control signal CS of the "H" level is not transferred to the OR circuit $\mathbf{1}_2$ until the output $O_1$ of the OR circuit $\mathbf{1}_1$ is actually brought to the "H" level, since the AND circuit $\mathbf{4}_1$ is connected between the input node of the control signal CS and the input of the OR circuit $\mathbf{1}_2$. Since the OR circuit $\mathbf{1}_2$ itself has a delay in signal propagation, the delay of the output signal $O_2$ from the output signal $O_1$ is a sum of a signal propagation delay of the AND circuit $\mathbf{4}_1$ and the signal propagation delay of the OR circuit $\mathbf{1}_2$. Similarly, the delay of the output signal $O_m$ from the output signal $O_{m-1}$ is a sum of a signal propagation delay of the AND circuit $\mathbf{4}_{m-1}$ and the signal propagation delay of the OR circuit $\mathbf{1}_m$. Thus, the output signals $O_1$ to $O_n$ are in no way simultaneously brought to the "H" level, but are sequentially brought to the "H" level in the order of the output signals $O_1$ to $O_n$.

On the other hand, when the control signal CS is brought to the "L" level, since the other input of the AND circuits is sequentially brought to the "L" level in the order of the AND circuits $\mathbf{4}_1$ to $\mathbf{4}_{n-1}$, the delay of the output signal $O_n$ from the output signal $O_{n-1}$ is the signal propagation delay of the AND circuit $\mathbf{4}_{n-1}$. In this case, the output signals $O_1$ to $O_n$ are in no way simultaneously brought to the "L" level, but are sequentially changed in their signal level in the order of the output signals $O_1$ to $O_n$, so that output signal $P_n$ of the shift register 2 is finally outputted as the output signal $O_n$.

As mentioned above, the second embodiment is such that after the output signal of a preceding stage has been actually changed, the output signal of a preceding stage is changed, and therefore, the change-over timing of the respective output signals $O_1$ to $O_n$ can be shifted or deviated one from another, more surely in comparison with the first embodiment.

Figure 3A:
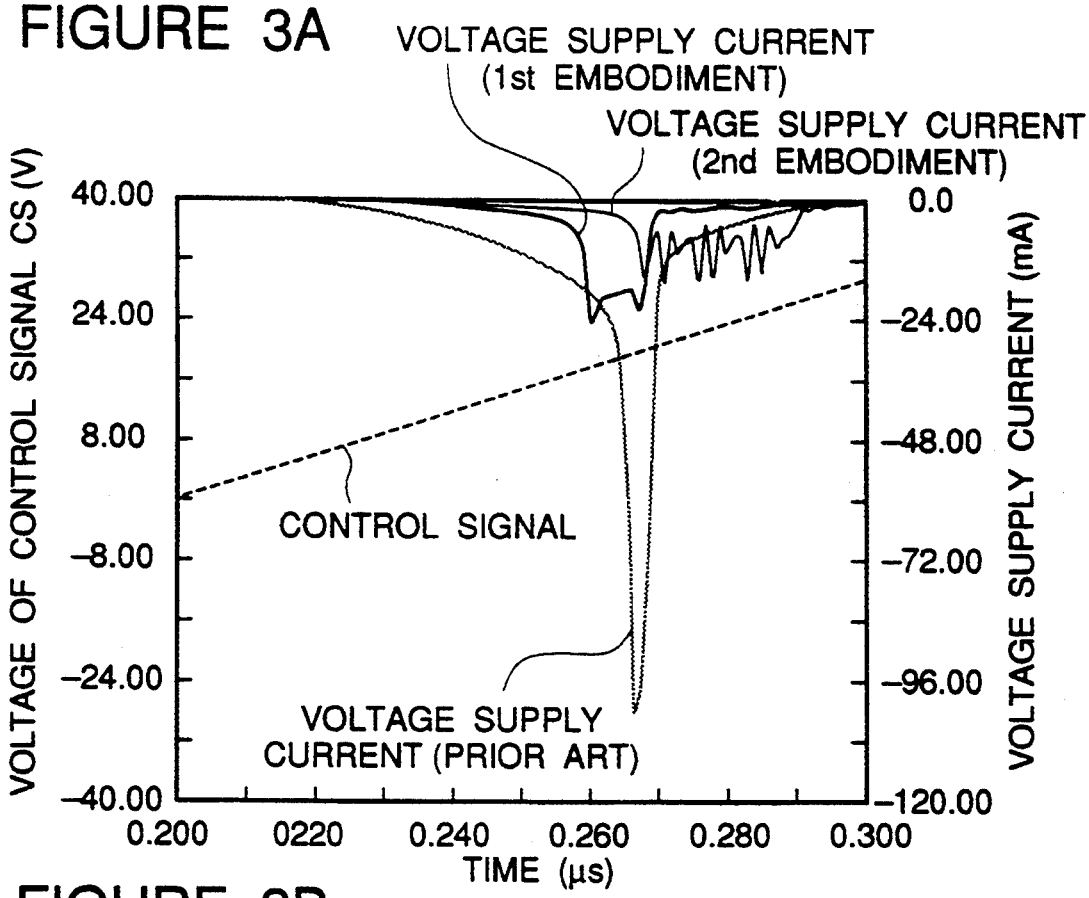
FIGS. 3A and 3B are graphs illustrating the transient pass-through current occurring in the first and second embodiments of the present invention and in the prior art output circuit.
Figure 3B:
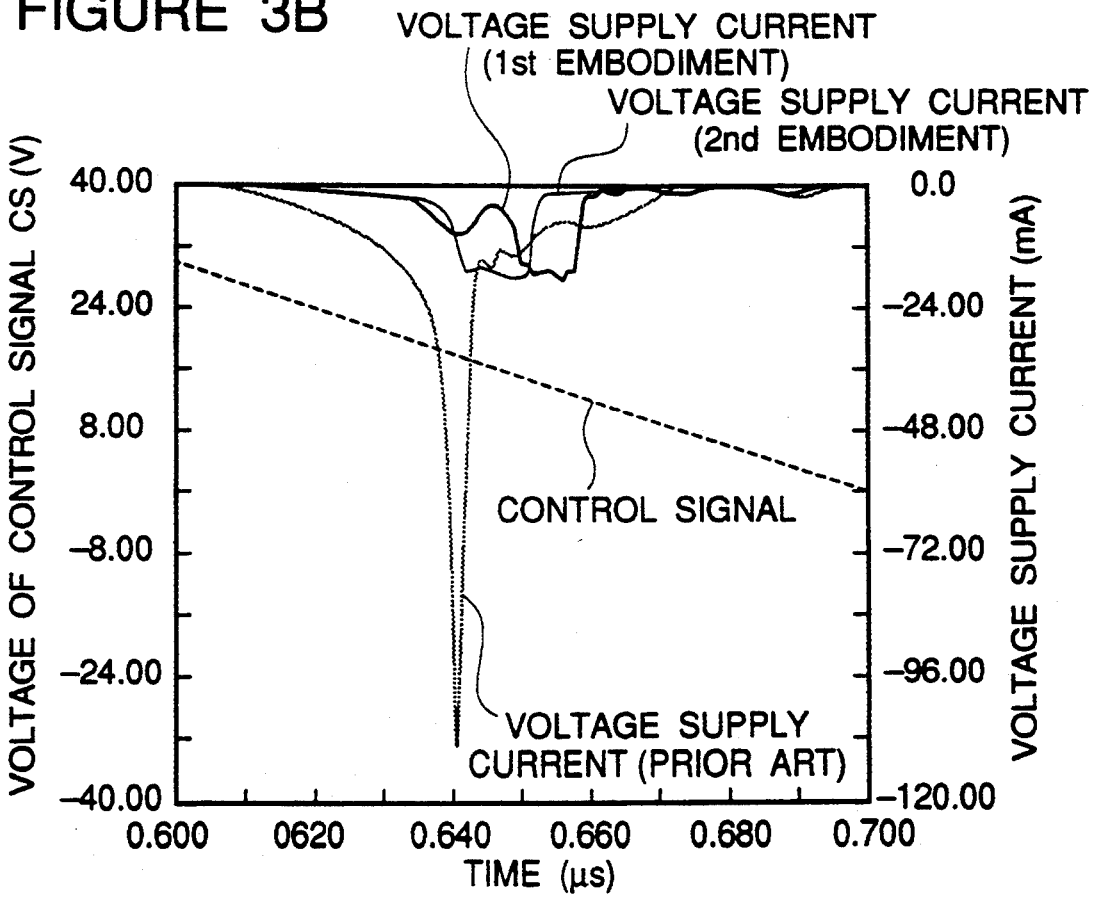

Referring to FIGS. 3A and 3B, there are shown the result of simulation of the transient change of a voltage supply current when all the output signals are brought to the "H" signal or the "L" signal in the first and second embodiments as mentioned above and in the prior art output circuit as mentioned in "Description of related art", under the assumption that the number of the output signals is 10 and the amplitude of the control signal CS is 30 V. FIGS. 3A shows the transient change of the voltage supply current when the control signal CS is changed from the "L" signal to the "H" signal with 100 nanoseconds, and FIGS. 3B shows the transient change of the voltage supply current when the control signal CS is changed from the "H" signal to the "L" signal with 100 nanoseconds.

It will be understood from FIGS. 3A and 3B that when the control signal CS is changed from the "L" signal to the "H" signal and when the control signal CS is changed from the "H" signal to the "L" signal, the transient voltage supply current does not exceed −25 mA at maximum in the first and second embodiments, and therefore, is reduced to about one-fourth of the transient voltage supply current of −100 mA in the prior art output circuit In the first and second embodiments, the output signals are sequentially changed with a predetermined delay time, differently from the prior art output circuit. However, if this delay time is determined so that the delay time appearing on the display panel is not sensible to eyes of a human being, this delay time is not a problem as the output circuit of the common driver for the flat panel display.

In the first and second embodiments, the control signal CS applied to the first OR circuit is sequentially delayed little by little and then supplied to succeeding OR circuits. However, as will be explained below in connection with third and fourth embodiments, it is possible to shift the timing of change of the output signals by connecting three-input logic circuits in a cascaded manner with respect to the output signal, but by simultaneously supplying the control signal CS to all the logic circuits.

Referring to FIG. 4A, there is shown a block diagram of a third embodiment of the output circuit in accordance with the present invention. In FIG. 4A, elements similar to those shown in FIG. 2A are given the same Reference Numerals.

The third embodiment includes the shifter register 2, the OR circuit $\mathbf{1}_1$ of the first stage, and three-input logic circuits $\mathbf{5}_2$ to $\mathbf{5}_n$ of a second stage to a "n"th stage, which are connected as shown. The OR circuit $\mathbf{1}_1$ has its one input connected to a corresponding bit $P_1$ of the shift register 2 and its other input connected to receive the control signal CS, and an output $O_1$ of the OR circuit $\mathbf{1}_1$ is connected to a corresponding row electrode of the flat panel display 10.

Each of the three-input logic circuits $\mathbf{5}_2$ to $\mathbf{5}_n$ has its first input "P" connected to a corresponding bit $P_2$ to $P_n$ of the shift register 2, and its second input "I" connected to receive the control signal CS, and its third input "Q" connected to the output signal $O_1$ to $O_{n-1}$ of the just preceding logic circuit. The three-input logic circuits $\mathbf{5}_2$ to $\mathbf{5}_n$ have its output "O" generating the output signals $O_2$ to $O_n$ supplied to corresponding row electrodes of the flat display panel. Therefore, these logic circuits are connected in a cascaded manner with respect to the output signals $O_1$ to $O_n$.

FIG. 4B is a logic circuit diagram of one example of the three-input logic circuits $\mathbf{5}_2$ to $\mathbf{5}_n$ used in the third embodiment shown in FIG. 4A. The three-input logic circuit is configured to realize the logical equation: $O_m = P_m \cdot \overline{CS} + O_{m-1} \cdot CS$. Namely, this three-input logic circuit includes a first AND gate 40 having its one input connected to the input "Q" of the logic circuit and its other input connected to the input "I" of the logic circuit, an inverter 42 having its input connected to the input "I", a second AND gate 44 having its one input connected to the input "P" of the logic circuit and its other input connected to an output of the inverter 42, and an OR gate 46 having its two inputs connected to an output of the AND gates 40 and 44 and its output connected to the output "O" of the logic circuit.

As will be seen from a truth table shown in FIG. 4C, the logic circuit shown in FIG. 4B outputs the output signal $P_m$ of the shift register 2 as the output signal $O_m$, when the control signal CS is at the "L" level. When the control signal CS is at the "H" level, the output signal $O_m$ of the logic circuit is brought to the "H" level only when the output signal $O_m$ of the just preceding logic circuit $\mathbf{5}_{m-1}$ is at the "H" level, regardless of the output signal $P_m$ of the shift register 2. Accordingly, when the control signal CS is brought to the "H" level, all the output signals $O_1$ to $O_n$ are in no way brought to the "H" level, but are sequentially brought to the "H" level in the order of the output signals $O_1$ to $O_n$.

Referring to FIG. 4D, there is shown a logic circuit diagram of another example of the three-input logic circuits $\mathbf{5}_2$ to $\mathbf{5}_n$ used in the third embodiment shown in FIG. 4A. The three-input logic circuit is configured to realize the logical equation: $O_m = P_m + CS \cdot O_{m-1}$. Namely, this three-input logic circuit includes an AND gate 50 having its one input connected to the input "Q" of the logic circuit and its other input connected to the input "I" of the logic circuit, and an OR gate 52 having its one input connected to the input "P" of the logic circuit and its other input connected to an output of the AND gate 50 and its output connected to the output "O" of the logic circuit.

As will be seen from a truth table shown in FIG. 4E, and similarly to the logic circuit shown in FIG. 4B, the logic circuit shown in FIG. 4D outputs the output signal $P_m$ of the shift register 2 as the output signal $O_m$, when the control signal CS is at the "L" level. However, when the control signal CS is at the "H" level, the output signal $O_m$ of the logic circuit is brought to the "H" level not only when the output signal $O_m$ of the just preceding logic circuit $\mathbf{5}_{m-1}$ is at the "H" level, but also when the output signal $P_m$ of the shift register 2 is at the "H" level. Accordingly, even in this example, when the control signal CS is brought to the "H" level, all the output signals $O_1$ to $O_n$ are sequentially brought to the "H" level in the order of the output signals $O_1$ to $O_n$. In addition, the second example can be constructed of elements less than those necessary for constructing the first example.

The above mentioned logic equation: $O_m = P_m + CS \cdot O_{m-1}$ can be converted to an equivalent inverted logic equation: $\overline{O_m} = \overline{P_m} \cdot (\overline{O_{m-1}} + \overline{CS})$. Referring to FIG. 5, there is shown a block diagram of a fourth embodiment of the output circuit in accordance with the present invention, which is configured to realize the equivalent inverted logic equation.

As shown in FIG. 5, the output signals $P_1$ to $P_n$ of the shift register 2 are supplied through inverters $6_1$ to $6_n$, respectively, and the control signal CS is supplied through an inverter 60. The OR circuit of the first stage is replaced with an AND circuit $8_1$, and each of the logic circuits $5_2$ to $5_n$ is formed of an OR circuit $9_2$ to $9_n$ having its first input connected to an output of the inverter 60 and its second input connected to an output of the just preceding logic circuit, and an AND circuit $8_2$ to $8_n$ having its first input connected to an output of the corresponding inverter $6_2$ to $6_n$ and its second input connected to an output of the associated OR circuit $9_2$ to $9_n$. An output of each of the AND circuits $8_2$ to $8_n$ is outputted through an inverter $7_1$ to $7_n$ as the output signal $O_1$ to $O_n$.

In this fourth embodiment, the inverters $6_1$ to $6_n$ and the inverters $7_1$ to $7_n$ functions as a buffer for the output signal $P_1$ to $P_n$ of the shift register 2 and as a buffer for the output signal $O_1$ to $O_n$ to be supplied to the display panel, respectively. When the circuit is actually designed, the fourth embodiment can be reduce the number of circuit elements in comparison with the example shown in FIG. 4D.

As will be apparent from the above, the output circuit in accordance with the present invention is so constructed that when all the output signals are forcibly brought to the "H" or "L" level in response to the control signal, all the output signals are in no way simultaneously changed, but are sequentially changed.

Therefore, when the output circuit is formed of the CMOS circuit, even if the number of output signals becomes large, the transient voltage supply current increase caused by the pass-through current of the respective CMOS circuits can be suppressed at a small value. Accordingly, if the output circuit in accordance with the present invention is used in an electronic display device driving circuit realized in an integrated circuit, it is possible to minimize the latch-up phenomenon, the noise superimposed on signal conductors, and the variation of the voltage supply voltage. This is very effective in stabilizing the circuit.

The invention has thus been shown and described with reference to the specific embodiments. However, it should be noted that the present invention is in no way limited to the details of the illustrated structures but changes and modifications may be made within the scope of the appended claims.

I claim:

1. An output circuit for a flat panel electronic display device driving circuit, the output circuit being configured to receive a plurality of input signals and controlled by one binary control signal so as to supply the received input signals as output signals when the control signal is at a first logical level, and to forcibly bring the output signals to the same logical level which is one level of a pair of complementary logical levels when the control signal is at a second logical level complementary to the first logical level, the output circuit including logic gate means for sequentially bringing the output signals to said same logical level when said control signal is at said second logical level, so that pass-through currents occurring due to the respective output signals do not flow simultaneously, whereby a voltage supply current is not greatly increased by said pass-through currents occurring due to the respective output signals.

2. An output circuit claimed in claim 1 wherein said plurality of input signals includes "n" input signals where "n" is a positive integer greater than 1, and wherein said logic gate means includes a first logic circuit of a two-input type having its first input connected to receive a first input signal of said "n" input signals and its second input connected to receive said binary control signal, an output of said first logic circuit generating a first output signal, and second to "n"th logic circuits of a three-input type each having its first input connected to receive a corresponding input signal of said "n" input signals excluding said first input signal, its second input connected to receive said binary control signal, and its third input connected to an output of a just preceding logic circuit, said logic circuits being configured to forcibly and sequentially bring their output signal to the same logical level which is one level of a pair of complementary logical levels, when the control signal is at said second logical level.

3. An output circuit claimed in claim 2 wherein said first logic circuit is formed of an OR circuit, and each of said second to "n"th logic circuits is configured to effect the following logical equation:

$$P_m \cdot \overline{CS} + O_{m-1} \cdot CS$$

where

CS is the binary control signal $\overline{CS}$ is an inverted signal of the binary control signal $P_m$ is a corresponding signal of the input signals $O_{m-1}$ is an output signal of the just preceding logic circuit.

4. An output circuit claimed in claim 3 wherein each of said second to "n"th logic circuits includes a first AND gate having its one input connected to receive an output signal of the just preceding logic circuit and its other input connected to receive said binary control signal, an inverter having its input connected to receive said binary control signal, a second AND gate having its one input connected to receive the corresponding one of said input signals and its other input connected to an output of said inverter, and an OR gate having its two inputs connected to an output of said first and second AND gates and its output connected to generate the output signal of the logic circuit.

5. An output circuit claimed in claim 2 wherein said first logic circuit is formed of an OR circuit, and each of said second to "n"th logic circuits is configured to effect the following logical equation:

$$P_m + CS \cdot O_{m-1}$$

where $P_m$ is a corresponding signal of the input signals

CS is the binary control signal $O_{m-1}$ is an output signal of the just preceding logic circuit.

6. An output circuit claimed in claim 5 wherein each of said second to "n"th logic circuits includes an AND gate having its one input connected to receive an output signal of the just preceding logic circuit and its other input connected to receive said binary control signal, and an OR gate having its one input connected to receive the corresponding one of said input signals, its other input connected to an output of said AND gate and its output connected to generate the output signal of the logic circuit.

7. An output circuit claimed in claim 2 wherein said first logic circuit is formed of an AND circuit having its first input receiving an inverted signal of the first signal of said input signals, its second input receiving an inverted signal of said binary control signal and its output connected through an inverter so as to generate the output signal, and each of said second to "n"th logic circuits is configured to effect the following logical equation:

$$\overline{P_m}\cdot(\overline{O_{m-1}}+\overline{CS})$$

where $P_m$ is an inverted signal of a corresponding signal of the input signals $\overline{O_{m-1}}$ is an inverted signal of an output signal of the just preceding logic circuit.

$\overline{CS}$ is an inverted signal of the binary control signal.

8. An output circuit claimed in claim 7 wherein each of said second to "n"th logic circuits includes an OR gate having its one input connected to receive through an inverter the just preceding logic circuit and its other input connected to receive the inverted signal of said binary control signal, and an AND gate having having its one input connected to receive an inverted signal of the corresponding one of said input signals, its other input connected to an output of said OR gate and its output connected through an inverter to generate the output signal of the logic circuit.

9. An output circuit for a flat panel electronic display device driving circuit, the output circuit including a plurality of two-input OR circuits having their one input connected to receive a corresponding number of input signals, the other input of a first OR circuit of said OR circuits being connected to receive a binary control signal, and a plurality of delay means connected in such a cascaded manner that a first one of said delay means is connected to receive said binary control signal, and each of the other delay means is connected at its input to the other input of a corresponding one of said OR circuits excluding said first OR circuit and at its output to the other input of an OR circuit just succeeding to said corresponding OR circuit, whereby when an output of said OR circuits is forcibly brought to one level of a pair of complementary logical levels in response to the control signal of an active logical level, the outputs of said OR circuits are sequentially brought to said one level of said pair of complementary logical levels with a delay given by said delay means.

10. An output circuit claimed in claim 9 wherein each of said delay means is formed of an non-inverting buffer having its input connected to the other input of said corresponding OR circuit and its output connected to the other input of said OR circuit just succeeding to said corresponding OR circuit.

11. An output circuit claimed in claim 9 wherein each of said delay means is formed of a two-input AND circuit having its first input connected to the other input of said corresponding OR circuit, its second input connected to the output of said corresponding OR circuit, and its output connected to the other input of said OR circuit just succeeding to said corresponding OR circuit.

* * * * *

UNITED STATES PATENT AND TRADEMARK OFFICE

CERTIFICATE OF CORRECTION

PATENT NO. : 5,432,529
DATED : July 11, 1995
INVENTOR(S) : Hiroaki AZUHATA

It is certified that error(s) appears in the above-identified patent and that said Letters Patent is hereby corrected as shown below:

Col. 2, line 40, delete "tho" and insert --the--.

Signed and Sealed this

Twenty-third Day of January, 1996

*Attest:*

Bruce Lehman

BRUCE LEHMAN

*Attesting Officer*

*Commissioner of Patents and Trademarks*